US011128054B2

(12) United States Patent
Thiessen

(10) Patent No.: US 11,128,054 B2
(45) Date of Patent: Sep. 21, 2021

(54) ANTENNA, REAR ACCESS, LINE REPLACEABLE UNIT RF PANEL ARCHITECTURE

(71) Applicant: Raytheon Company, Waltham, MA (US)

(72) Inventor: Phillip W. Thiessen, Wellesley, MA (US)

(73) Assignee: Raytheon Company, Waltham, MA (US)

( * ) Notice: Subject to any disclaimer, the term of this patent is extended or adjusted under 35 U.S.C. 154(b) by 211 days.

(21) Appl. No.: 16/373,917

(22) Filed: Apr. 3, 2019

(65) Prior Publication Data

US 2020/0321709 A1 Oct. 8, 2020

(51) Int. Cl.
*H01Q 21/06* (2006.01)
*H01Q 1/12* (2006.01)

(52) U.S. Cl.
CPC ..... *H01Q 21/061* (2013.01); *H01Q 1/1207* (2013.01); *Y10T 29/49018* (2015.01)

(58) Field of Classification Search
CPC ..... H01Q 21/061; H01Q 21/0025; Y10T 29/49018
See application file for complete search history.

(56) References Cited

U.S. PATENT DOCUMENTS

| | | | | |
|---|---|---|---|---|
| 8,988,172 | B1 | 3/2015 | Angelucci | |
| 2004/0017322 | A1* | 1/2004 | Bostwick | H01Q 13/06 343/776 |
| 2005/0110681 | A1* | 5/2005 | Londre | H01Q 25/00 343/700 MS |
| 2008/0169973 | A1 | 7/2008 | Pluymers | |
| 2008/0204350 | A1* | 8/2008 | Tam | H01Q 21/0025 343/872 |
| 2019/0021191 | A1 | 1/2019 | Jones | |

OTHER PUBLICATIONS

International Search Report and Written Opinion for corresponding International Application PCT/US2020/025253 dated Jun. 8, 2020.

* cited by examiner

*Primary Examiner* — Ricardo I Magallanes
(74) *Attorney, Agent, or Firm* — Renner, Otto, Boisselle & Sklar, LLP

(57) ABSTRACT

An array antenna assembly includes a frame support structure and a plurality of line replaceable units that each include a panel having a front surface on which a plurality of radiating elements are disposed, and a rear surface opposing the front surface, and a bracket that extends from the rear surface and has orthogonal flanges that are engageable with the frame support structure to align the line replaceable unit within the array antenna.

19 Claims, 8 Drawing Sheets

ANTENNA, REAR ACCESS, LINE REPLACEABLE UNIT RF PANEL ARCHITECTURE

FIELD OF THE INVENTION

The invention relates to an array antenna, and more particularly to mounting structures for array antennas.

DESCRIPTION OF THE RELATED ART

A phased array antenna is an array of radiating elements in which the relative phases of the signals feeding the antennas are varied to produce a directive radiation pattern. Various applications may use phased array antennas, such as radar or communication systems for commercial or military applications. A phased array antenna may be suitable for use in marine vessels, land vehicles, aircrafts, or space vehicles. For example, a surveillance system for an aircraft may use a phased array antenna.

Phased array antennas may require routine maintenance or removal and replacement of panels of the array that contain the radiating elements. However, conventional radiating element panels are bolted to the front of a mount or support structure such that only the front area of the array is accessible to an operator attempting to perform maintenance. Accordingly, accessing the panels and maintaining the array structure is difficult, especially for larger array structures.

SUMMARY OF THE INVENTION

Using uniquely configured line replaceable unit (LRU) in an array antenna is advantageous in providing structural rigidity, alignment, and rear access that improves the ability to maintain the array antenna. The array antenna includes a plurality of LRUs that are rigidly connectable and removable relative to a support frame of the array antenna. Each LRU has a right-angle bracket with orthogonal flanges that provide the structural rigidity and predetermined alignment of the LRU when the LRU is mounted to the support frame. Feature of the LRU ensures precise element-to-element alignment as the LRU may include various electrical and/or mechanical elements, such as cooling connections, electrical connections, and RF connections. When the plurality of LRUs are mounted within the array antenna, each LRU is arranged with proper alignment and spacing relative to the other LRUs such that radiating elements of the LRUs are configured to obtain a desired scanning angle of the array antenna.

The support frame is formed to be grid-shaped or window-pane shaped such that the vertical beams are engageable against corresponding horizontal beams of the support frame for alignment of the LRUs. Fasteners are used to secure the flanges of each LRU bracket to corresponding orthogonal beams of the support frame. The LRUs are mounted within windows or openings that are defined by the orthogonal beams and provide rear access to the LRU through the support frame, as compared with conventional array antennas that only enable front access to the array antenna. Providing rear access is particularly advantageous in applications using large aperture array antennas having dimensions, such as lengths, widths, heights, etc. that are at least several meters.

Each LRU includes an RF circuit card panel having both the radiating elements and RF integrated circuit (IC) components arranged on the front side of the LRU, a power conditioning input and output panel (I/O panel) that is attached behind the RF panel. The I/O panel is an electromechanical interface having a front surface which faces the RF panel and a rear surface opposing the front surface. The right-angle mounting bracket extends in a perpendicular direction from the rear surface. The right angle mounting bracket provides two orthogonal flanges meeting at a corner of the rear surface. The arrangement of the bracket is advantageous in that the bracket enables mounting to the support frame while also enabling access to the rear surface of the I/O panel. A pull mechanism or other handling device may be arranged on the rear surface to enable removal and handling of the LRU.

Each opening of the support frame may support a subassembly of four LRUs that are arranged in a puzzle-type arrangement or interlocking arrangement in which the rear surfaces of each I/O panel are adjacent to each other and lay in a common plane. Providing subassemblies of four LRUs per frame opening is advantageous in that the subassembly enables one of the LRUs to be withdrawn rearwardly and then moved laterally toward a center of the subassembly and opening to be completely removed from the array antenna without disturbing the surrounding LRUs and radiating elements. The LRU is configured to enable the rapid removal and/or replace cement of the LRU as a self-contained unit.

The LRU configuration is further advantageous in enabling modularity of the array antenna. Using the support frame and mounting brackets of the LRUs, the support frame may be able to support different numbers and arrangements of LRUs. LRUs may be easily removed or added to the support frame. The LRU also enables any suitable mechanical or electrical connections to be incorporated in the LRU, which renders LRUs suitable for different applications. The support frame is also adaptable for mounting to any suitable platform in different applications. For example, the array antenna assembly having the support frame and the LRUs may be feasible for stationary platforms, such as buildings, or moving platforms such as a sea vessels, land vehicles, aircrafts, or space vehicles. Many other applications may be suitable.

According to an aspect of the invention, an array antenna includes a right-angle, rear-accessible, mounting bracket.

According to an aspect of the invention, an array antenna includes a plurality of line replaceable units.

According to an aspect of the invention, an array antenna includes a plurality of line replaceable units that each have an electrotechnical panel and a right-angle mounting bracket.

According to an aspect of the invention, a line replaceable unit for an array antenna includes an electromechanical panel having a front surface in communication with electronics of the array antenna, and a rear surface opposing the front surface, and a mounting bracket that is attached to the rear surface and extends perpendicular to the rear surface opposite the electronics, wherein the mounting bracket has orthogonal flanges that are configured to align the line replaceable unit within the array antenna.

According to an embodiment of any paragraph(s) of this summary, the orthogonal flanges may extend along outer edges of the rear surface, whereby most of the rear surface is exposed.

According to an embodiment of any paragraph(s) of this summary, the bracket may have two orthogonal flanges that form a corner located at a corner of the rear surface.

According to an embodiment of any paragraph(s) of this summary, the two orthogonal flanges may be integrally formed.

According to an embodiment of any paragraph(s) of this summary, at least one of the orthogonal flanges includes at least one of a cooling element or an RF connector.

According to an embodiment of any paragraph(s) of this summary, the line replaceable unit may include a pull mechanism mounted on the rear surface of the panel.

According to another aspect of the invention, an array antenna assembly includes a frame support structure, and a plurality of line replaceable units that each include a panel having a front surface on which a plurality of radiating elements are disposed, and a rear surface opposing the front surface, and a bracket that extends from the rear surface and has orthogonal flanges that are engageable with the frame support structure to align the line replaceable unit within the array antenna.

According to an embodiment of any paragraph(s) of this summary, the frame support structure may be grid-shaped and defines a plurality of openings through which the rear surface of each of the line replaceable units is accessible.

According to an embodiment of any paragraph(s) of this summary, each of the openings may be configured to support a subassembly having four line replaceable units.

According to an embodiment of any paragraph(s) of this summary, the subassembly may include two sets of identical line replaceable units, wherein identical line replaceable units are diagonally opposed to each other.

According to an embodiment of any paragraph(s) of this summary, the rear surface of each of the four line replaceable units may lay flat with each other in a common plane.

According to an embodiment of any paragraph(s) of this summary, the array antenna assembly may include a plurality of fasteners that connect the line replaceable units to the frame support structure.

According to an embodiment of any paragraph(s) of this summary, the fasteners may be shear fasteners that are attached between the bracket and the frame support structure.

According to an embodiment of any paragraph(s) of this summary, the frame support structure may include a plurality of orthogonal beams that each have a first mounting surface and a second mounting surface that extends from the first mounting surface, wherein the shear fasteners are engageable against the first mounting surface.

According to another aspect of the invention, a method of assembling and maintaining an array antenna assembly includes forming a frame support structure, forming a plurality of line replaceable units that each include a panel having a front surface on which a plurality of radiating elements are disposed and a rear surface opposing the front surface, and a bracket that extends from the rear surface and has orthogonal flanges, and mounting the plurality of line replaceable units to the frame support structure by engaging the orthogonal flanges with the frame support structure to align the line replaceable unit within the array antenna.

According to an embodiment of any paragraph(s) of this summary, the method may further include mounting the frame support structure to a support beam on an existing structure.

According to an embodiment of any paragraph(s) of this summary, mounting the plurality of line replaceable units may include arranging the rear surface of each of the plurality of line replaceable units to be accessible through openings defined by a plurality of orthogonal beams of the frame support structure.

According to an embodiment of any paragraph(s) of this summary, mounting the plurality of line replaceable units to the frame support structure may include arranging four line replaceable units to form a subassembly that is configured to fit into one of the openings.

According to an embodiment of any paragraph(s) of this summary, the method may further include removing one of the line replaceable units from the frame supporting structure by accessing the rear surface through the frame support structure.

According to an embodiment of any paragraph(s) of this summary, removing one of the line replaceable units may include moving the line replaceable unit in a rear direction away from a plane in which the other line replaceable units are arranged, and moving the line replaceable unit in a lateral direction away from the frame support structure.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

The principles described herein have particular application in phased array antenna structures. An array antenna assembly that includes individual electromechanical units having right-angle brackets that are rigidly connectable and removable relative to a support frame of the assembly is advantageous in both providing rear access to the units for maintenance and in providing alignment of each unit when mounted. For example, the brackets provide precise element-to-element alignment for any RF connections, electrical connections, and cooling mechanisms of each unit. The array antenna assembly may be suitable for use in various applications that use phased array antennas, such as in radar or communication systems for commercial or military applications. The array antenna assembly may be mounted to any suitable structure or platform, such as a moving vehicle or a stationary building. Still another exemplary application includes power generation for solar cells in which mirror arrays are used. Many other applications may be suitable and the array antenna assembly may be scaled up or down depending on the application.

The array antenna assembly includes a frame support structure that supports a plurality of line replaceable units (LRUs) that are rigidly connectable and removable relative to the frame support structure. Each of the LRUs includes an RF panel having radiating elements, an input and output panel (I/O panel), and a right-angle bracket. The I/O panel has a front surface that faces the RF panel, and a rear surface that opposes the front surface. The right-angle bracket extends outwardly from the rear surface opposite the RF panel. The right-angle bracket includes orthogonal flanges that extend perpendicular to the rear surface and along edges of the rear surface such that the right angle formed by the flanges is located at a corner of the rear surface.

Using the orthogonal flanges enables the bracket to provide alignment of the LRU when engaged with corresponding orthogonal beams of the frame support structure, while also providing access to the rear surface of the I/O panel. Each LRU is removable by being withdrawn from the array antenna assembly in a rear direction, such as by an operator who is located behind the array antenna assembly and pulls the LRU toward him or her. After rearward displacement, the LRU may then be laterally shifted to be completely removed from the frame support structure without interfering with the other LRUs, such that one of the LRUs may be replaced or undergo maintenance.

Figure 1:
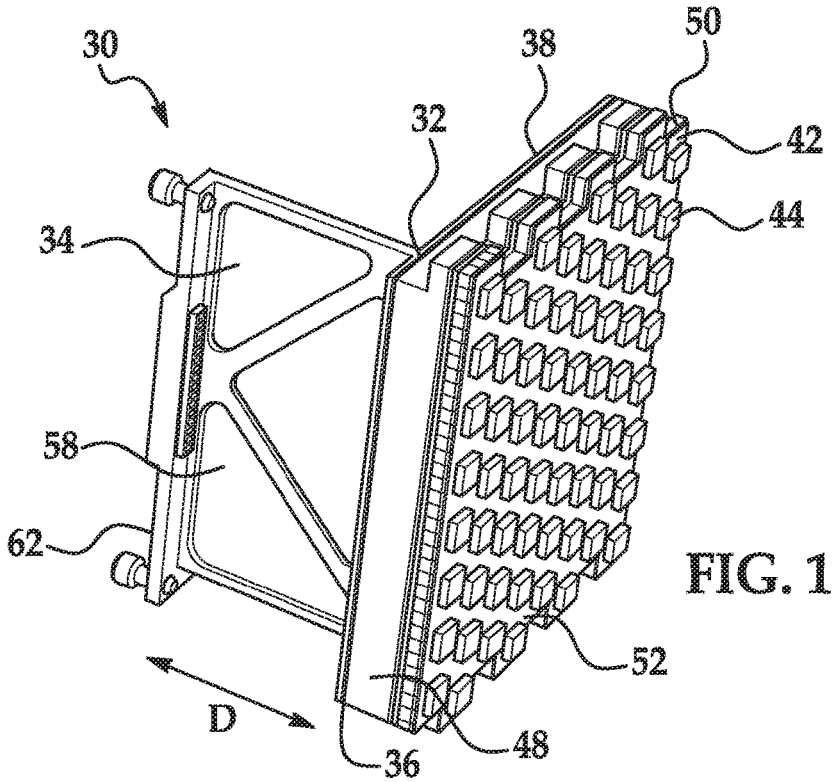
FIG. 1 shows an oblique view of a line replaceable unit (LRU) according to an embodiment of the invention.
Figure 2:
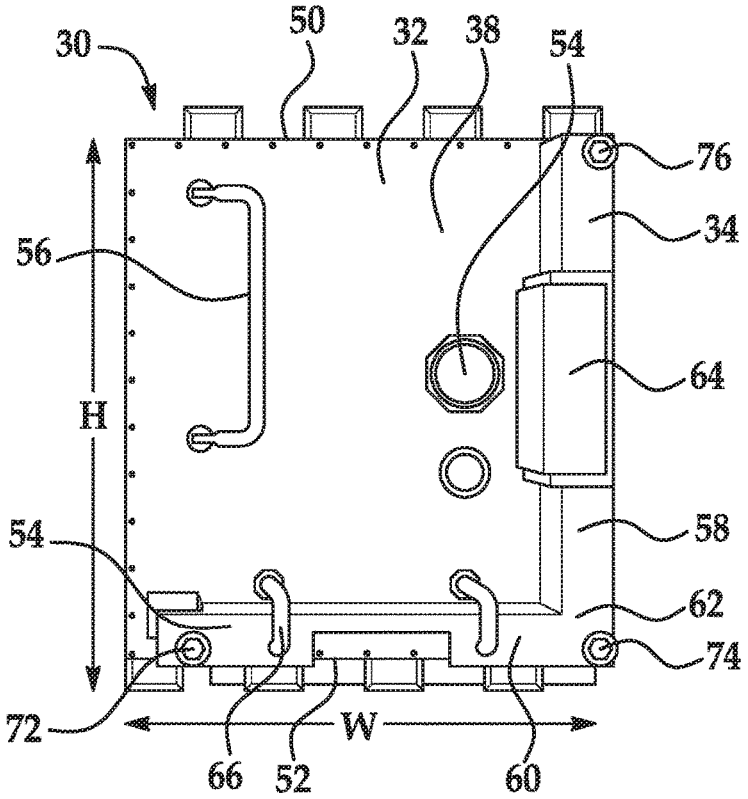
FIG. 2 shows a rear view of the LRU of FIG. 1.
Figure 3:
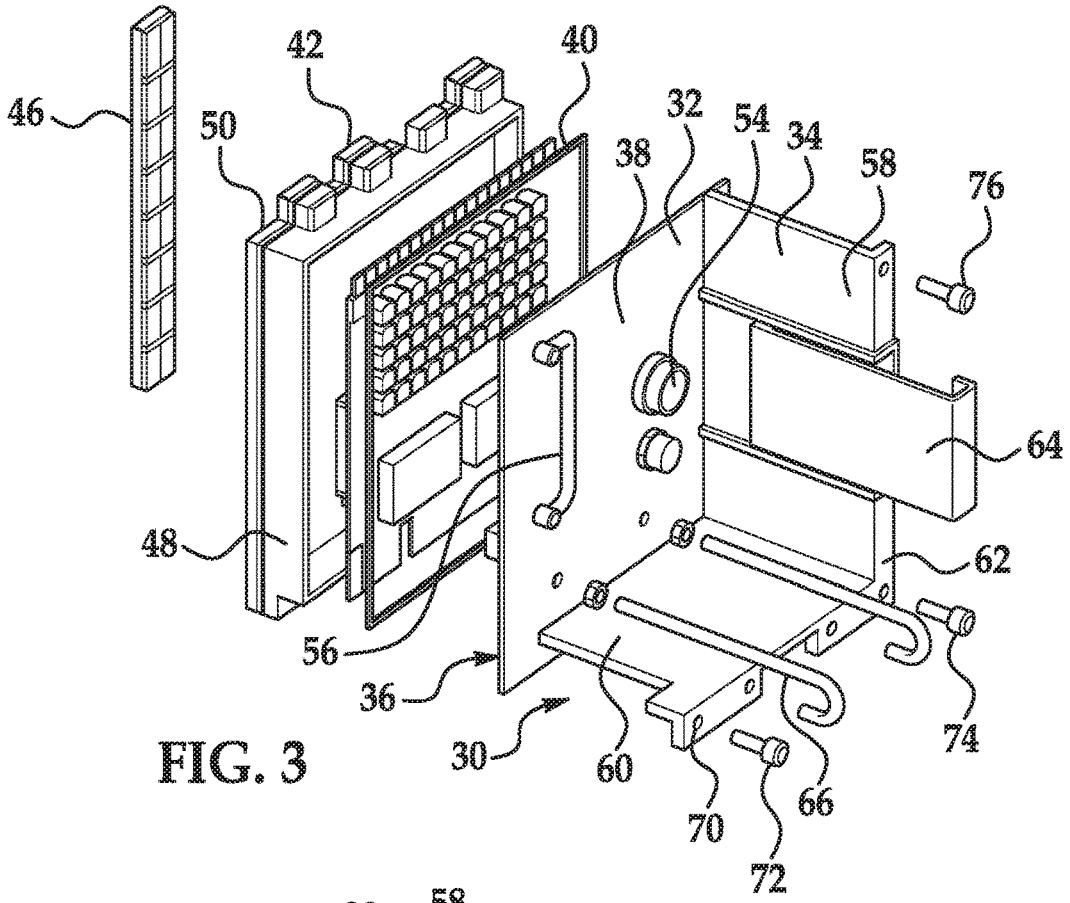
FIG. 3 shows an exploded view of the LRU of FIG. 1.
Figure 4:
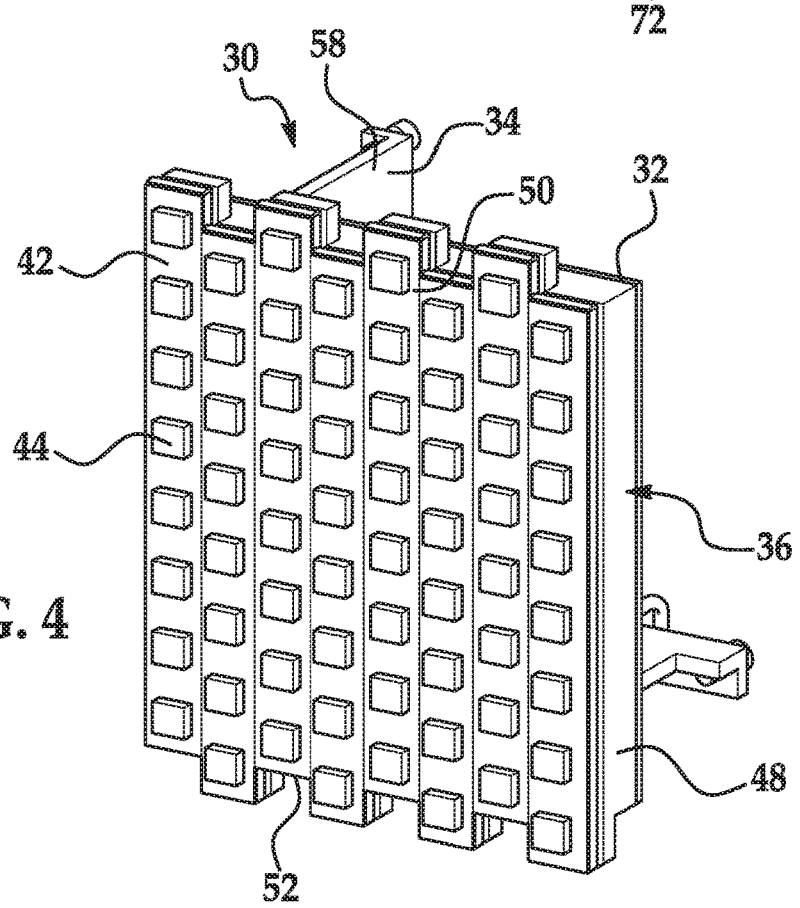
FIG. 4 shows a front oblique view of the LRU of FIG. 1.

FIGS. 1-4 show an exemplary LRU 30 for an array antenna assembly according to the present application. The LRU 30 includes an I/O interface, or I/O panel 32, and a bracket 34 that is attached to the I/O panel 32. The I/O panel 32 may be rectangular in shape and have a front surface 36, and a rear surface 38 opposing the front surface 36. The front surface 36 faces electronics of the LRU 30 and the electronics may be in communication with electronics of the front surface 36. The electronics includes a circuit card assembly 40, as best shown in FIG. 3, and an RF panel 42 having at least one antenna element or radiating element 44 and a monolithic microwave integrated circuit (MMIC) 46, as best shown in FIGS. 1, 3 and 4. The LRU 30 may further include a cold plate 48 in which the circuit card assembly 40 is mounted adjacent to the front surface 36 of the I/O panel 32. The RF panel 42 may be mounted on the opposing side of the cold plate 48 relative to the circuit card assembly 40. The I/O panel 32 may be configured for both mechanical connection and electrical communication with any other suitable electronics and mechanical devices. For example, other mechanical devices may include different types of cooling devices or heat exchangers that are arranged in the LRU 30.

Each radiating element 44 of the RF panel 42 is spaced to achieve a desired frequency which may be dependent on the application in which the array antenna is being used. Suitable frequency letter bands include an S band, X band, C band, L band, or UHF band. Any suitable number of radiating elements may be used and the spacing between each radiating element 44 may be selected to provide a preferred scan angle. As the electronics are mounted on the front surface 36 of the LRU 30, the front side of the LRU 30 is used for RF communication of the array antenna. In an exemplary embodiment, the RF panel 42 may be castellated on a top edge 50 and a bottom edge 52 of the RF panel 42 to accommodate triangular element spacing. In still other exemplary embodiments, the RF panel 42 may be a segmented RF radiator panel having a square or rectangular element spacing.

The I/O panel 32 is configured for electrical communication with the circuit card assembly 40 and housing the circuit card assembly 40, such that the I/O panel 32 provides an electromechanical interface for the LRU 30. The I/O panel 32 may further include any suitable power and signal I/O 54, as shown in FIGS. 2 and 3. When the LRU 30 is assembled within the array antenna assembly, the rear surface 38 of the I/O panel 32 is accessible such that the power and signal I/O 54 is also accessible. The I/O panel 32 being accessible refers to an operator, which may be a manual operator or an automatic operator, being able to contact the I/O panel 32 and physically move the LRU 30. A pull mechanism or handling device, such as a foldable handle 56, may also be pivotably mounted to the rear surface 38 and accessible for removal of the LRU 30 from the assembly as will be described further below. Any other suitable accessible attachment or hardware that enables handling of the LRU 30 may be provided. For example, other pull mechanisms such as knobs or cables may be used.

The bracket 34 of the LRU 30 extends perpendicular to the rear surface 38 of the I/O panel 32 in a direction that is opposite to the electronics of the LRU 30. The bracket 34 includes at least two orthogonal flanges 58, 60 that are straight and meet at a corner 62 such that the orthogonal flanges 58, 60 are formed at a 90 degree or right angle relative to each other. The orthogonal flanges 58, 60 may be formed integrally with each other or as separate components that are adjoined using any suitable joining process, such as welding. Similar to the I/O panel 32, the orthogonal flanges 58, 60 may also be configured as electromechanical interfaces that support any suitable additional mechanical or electrical features of the LRU 30. The orthogonal flanges 58, 60 may be configured to support RF connections, other electrical connections, or cooling mechanisms. For example, one orthogonal flange 58 may be configured to support a beam former feed through 64 that is in electrical communication with the radiating elements of the RF panel 42. Another orthogonal flange 60 may be configured to support a cooling mechanism 66 such as supply and/or return lines for cooling the electronics of the LRU 30. The orthogonal flanges 58, 60 may be configured to support other electrical or mechanical features of the LRU 30 and the features may be dependent on the application.

Each of the orthogonal flanges 58, 60 extends along a corresponding outer edge or perimeter of the rear surface 38 of the I/O panel 32, such that most of the surface area of the rear surface 38 is exposed or accessible. The corner 62 at which the right angle between the orthogonal flanges 58, 60 is formed is thus located at a corner of the rear surface 38. As shown in FIG. 2, the first orthogonal flange 58 extends in a direction in which the height H of the I/O panel 32 extends and the first orthogonal flange 58 may extend along at least most of the distance of the height H. The second orthogonal flange 60 extends in a direction in which the width W of the I/O panel 32 extends and the second orthogonal flange 60 may extend along at least most of the distance of the width W.

The I/O panel 32 may have any suitable height H and width W, and the height H and width W of the I/O panel 32 may define the height and width of the entire LRU 30. For example, the height H and the width W may be greater than 0.3 meters (1 foot). The height H and the width W may have a length that is between 0.3 meters and 0.6 meters (between 1 and 2 feet). The height H may be greater than the width W such that the I/O panel 32 is rectangular in shape, but in other exemplary embodiments, the I/O panel 32 may have equivalent dimensions such that the I/O panel 32 is square-shaped. The bracket 34 may extend from the I/O panel 32 by a distance D that is less than the width W or the height H. The dimensions are merely exemplary and many other dimensions may be suitable. The I/O panel 32 and the bracket 34 may be formed of any suitable material and manufactured using any suitable manufacturing process. Metal materials may be suitable. The LRU 30 may also have any suitable weight which may be dependent on the electrical components or cooling components being supported by the LRU 30. In an exemplary application, the LRU 30 may weigh between 11 and 14 kilograms (between 25 and 30 pounds), but the LRU 30 may be sized up or down depending on the application.

Figure 5:
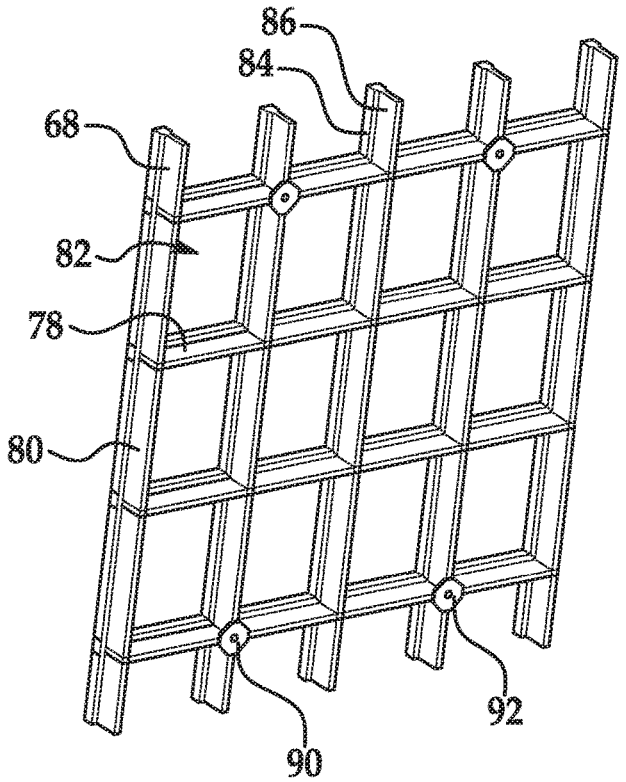
FIG. 5 shows an oblique view of a support frame assembly for the LRU of FIG. 1.
Figure 6:
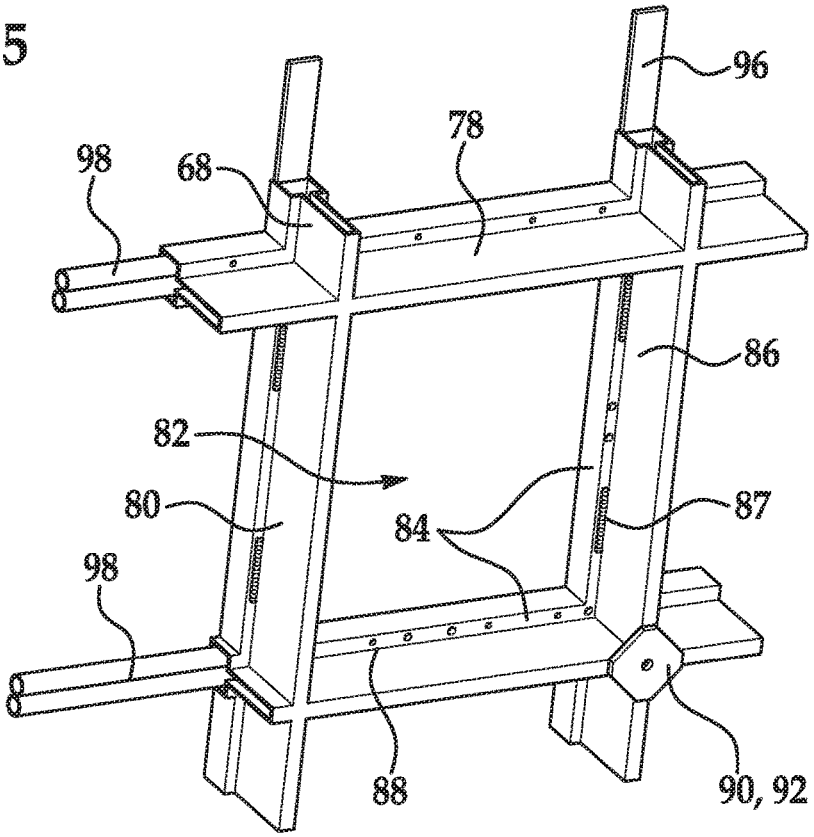
FIG. 6 shows an oblique view of the window opening and LRU attachment points, cooling connections, and beamformer I/O connectors on the support frame assembly of FIG. 5.

Referring in addition to FIGS. 5 and 6, the LRU 30 is secured to a frame support structure 68 using any suitable fastening mechanism. The bracket 34 includes at least one fastener-receiving hole 70 formed on the bracket 34. A plurality of fastener-receiving holes may be provided and the fastening mechanism may include a plurality of shear fasteners 72, 74, 76, as shown in FIGS. 2 and 3, that are each received within the corresponding fastener-receiving hole 70. Other suitable fasteners include bolts, pins, screws, and nuts and any suitable number of fasteners may be used. For example, three shear fasteners 72, 74, 76 may be used and the shear fasteners 72, 74, 76 may be arranged at opposite locations along the bracket 34. For example, the middle shear fastener 74 may be arranged at the corner 62 of the bracket 34 and aligned with the shear fastener 72 along the length of the orthogonal flange 60. The middle shear fastener 74 may be aligned with the shear fastener 76 along a length of the other orthogonal flange 58. The shear fasteners 72, 74, 76 may be arranged to extend in a direction that is perpendicular to the rear surface 38 of the I/O panel 32. The shear fasteners 72, 74, 76 extend through the corresponding orthogonal flange 58, 60 to engage the frame support structure 68 and secure the LRU 30 to the frame support structure 68.

The frame support structure 68 is configured to support a plurality of LRUs when each LRU 30 is secured to the frame support structure 68 with the fastening mechanism. The frame support structure 68 may be sized to accommodate any number or arrangement of LRUs and the size may be dependent on the application. Advantageously, the frame support structure 68 may be formed to enable adding or removing LRUs such that the frame support structure 68 in conjunction with the LRUs enables modularity of an array antenna construction. The frame support structure 68 is grid-shaped or window-pane shaped, and formed of a plurality of orthogonal beams 78, 80 that extend parallel and perpendicular to each other. As shown in FIG. 6, groups of four orthogonal beams 78, 80 each define a window or opening 82 through which the rear surface 38 of each LRU 30 is accessible when assembled. The frame support structure 68 includes horizontal and vertical orthogonal beams 78, 80, respectively, such that each opening 82 is rectangular in shape. Each group of beams 78, 80 includes two vertical beams and two horizontal beams. The beams being horizontal and vertical refers to a general orientation of the frame support structure 68 when in an upright and vertical orientation. In operation, when the frame support structure 68 is assembled, the horizontal and vertical beams may be angled relative to a horizontal and vertical direction as the entire frame support structure 68 may have an angled orientation.

As shown in FIG. 6, the orthogonal beams 78, 80 each have a LRU mounting surface 84 that protrudes horizontally and vertically from the corresponding beam 78, 80 having a vertical beam portions and a horizontal beam portion 86. The LRU mounting surface 84 provides a surface for engagement by the three shear fasteners 72, 74, 76 of the LRU 30 that engage the LRU mounting surface 84 through the bracket 34. Each bracket 34 is mounted to two orthogonal mounting surfaces corresponding to a vertical beam 80 and corresponding to a horizontal beam 78. The engagement between the frame support structure 68 and the bracket 34 of each LRU 30 is advantageous in that the orthogonal flanges 58, 60 of the bracket 34 are aligned with the corresponding orthogonal beams 78, 80 of the frame support structure 68 to ensure more precise alignment of the LRUs as compared with conventional mounting devices. The LRU mounting surface 84 may also provide electrical/RF interconnectors 87 and liquid quick disconnect couplings 88.

The frame support structure 68 may further include a plurality of attachment points 90, 92 that are attached to one side of the frame support structure 68 for attaching the frame support structure 68 to a side of a building or other suitable platform. The attachment points 90, 92 may be arranged at junctions of the frame support structure 68 at which the orthogonal beams 78, 80 meet. The attachment points 90, 92 may be attached to the frame support structure using any suitable attachment mechanism or manufacturing process. For example, the attachment points 90, 92 may be welded to the frame support structure 68. Any suitable number of attachment points 90, 92 may be provided and the number of attachment points 90, 92 may be dependent on the application. The entire frame support structure 68 may be formed using any suitable manufacturing process and formed of any suitable material. Metal materials, such as carbon sheet steel, may be suitable materials for the frame support structure 68.

Figure 7:
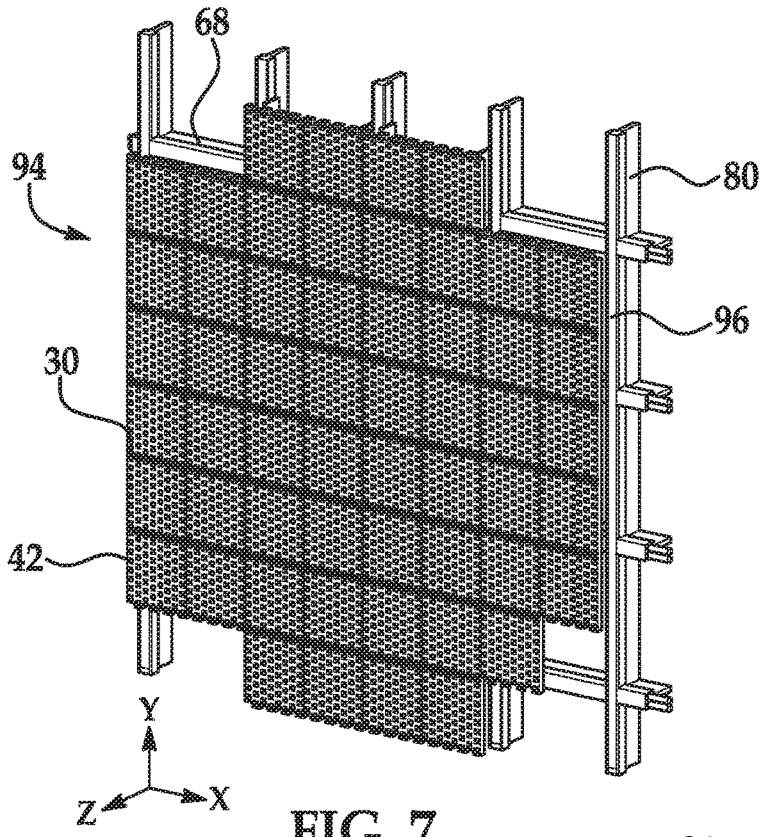
FIG. 7 shows a front oblique view of an array antenna assembly that includes the LRU of FIG. 1 and the support frame assembly of FIG. 5.
Figure 8:
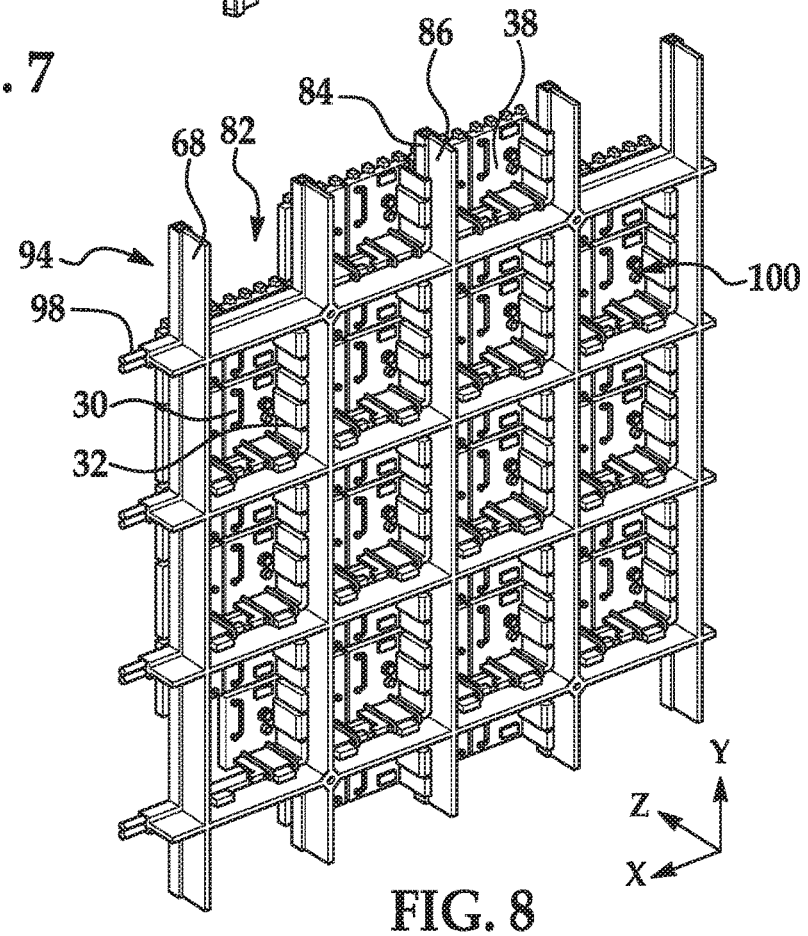
FIG. 8 shows a rear oblique view of the array antenna assembly of FIG. 7.

Referring now to FIGS. 7 and 8, an exemplary array antenna assembly 94 is shown. The array antenna assembly 94 includes a plurality of LRUs being attached to and supported by a frame support structure 68. FIG. 7 shows the front side of the array antenna assembly 94 and FIG. 8 shows the rear side of the array antenna assembly 94. Using the LRU 30 having the right-angle bracket 34 is advantageous in that the interface between the frame support structure 68 and the LRUs provides planarity and precise element spacing for each RF panel 42, while also enabling access to the rear surface 38 of each LRU 30. Thus, an operator can easily perform maintenance or replace an LRU 30 without having to access the front side of the array antenna assembly 94. The RF panels may be arranged in a horizontal or x-direction and in a vertical or y-direction and the LRUs are accessible in a z-direction from the rear surface 38. The x, y, and z-directions refer to a general orientation of the array antenna assembly 94 when in a vertical upright orientation.

In operation, when the array antenna assembly 94 is assembled and in use, the array antenna assembly 94 may be angled.

Any suitable number of LRUs may be provided and the number of LRUs may be dependent on the application. In the exemplary embodiment shown in FIG. 7, the array antenna assembly 94 has 48 LRUs that each have 64 antenna elements. In another exemplary embodiment, 42 LRUs with 2688 antenna elements may be used in the array antenna assembly. The LRUs may be formed in uniform columns and rows, or, as shown in FIG. 7, some rows and columns may include more or fewer LRUs depending on the application. Many arrangements of the LRUs are suitable and the arrangement of the LRUs and antenna elements may depend on a preferred scanning angle of the array antenna. The array antenna assembly 94 may have any suitable size. For example, the array antenna assembly 94 may provide an antenna aperture having a diameter that is between 3 and 16 meters (between 10 and 50 feet). The frame support structure 68 may have any suitable area dimensions to support a corresponding plurality of LRUs.

The assembled array antenna assembly 94 may be configured to support additional mechanical or electrical features such as at least one vertical beam former 96 and a cooling, signal and power distribution system 98. Each vertical beam former 96 may be attached to a corresponding vertical orthogonal beam 80 and extend in the vertical direction or y-direction. The cooling, signal and power distribution system 98 may include supply and return lines that are supported within hollow cavities of the frame support structure 68 such that the cooling and power distribution system 98 is spread over the entire area of the array antenna assembly 94. The cooling and power distribution system 98 may be in communication with each LRU 30.

Figure 9:
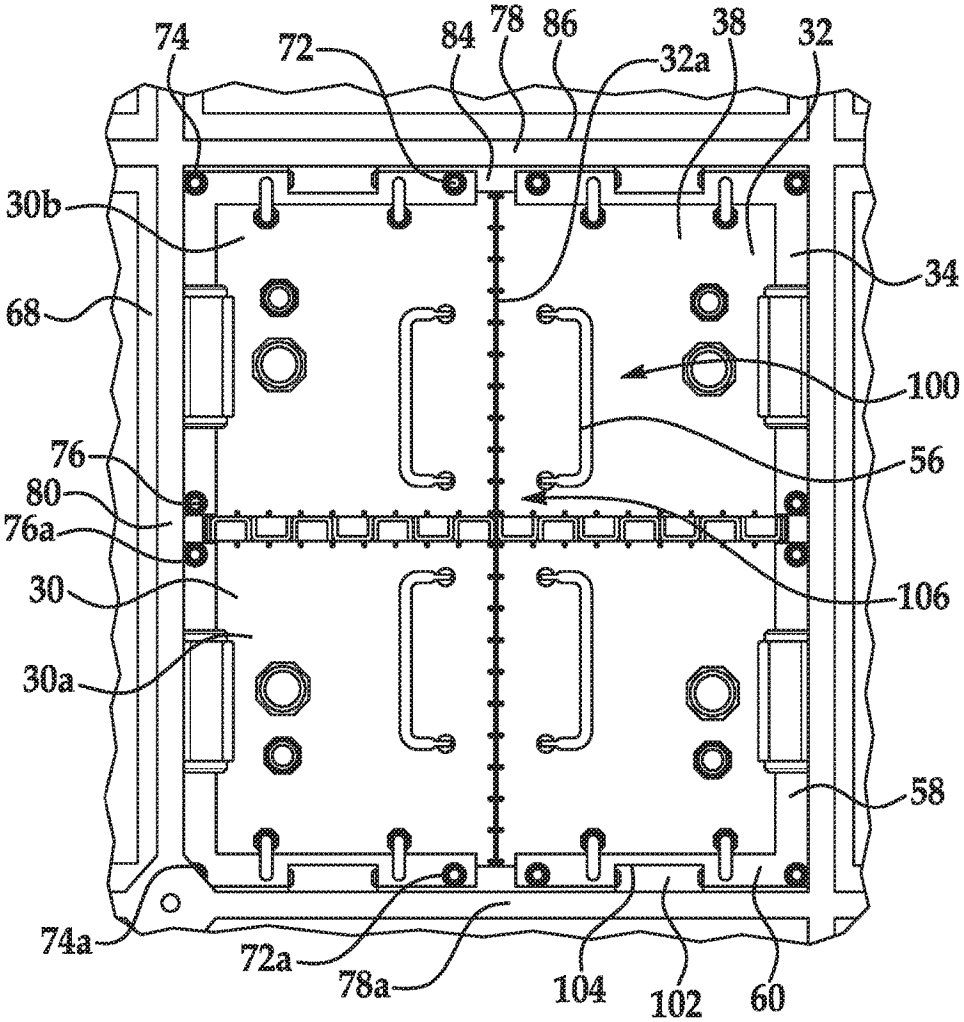
FIG. 9 shows a rear view of a subassembly of LRUs of the array antenna of FIG. 7.

Referring in addition to FIG. 9, each opening 82 of the frame support structure 68 is configured to receive four LRUs that are arranged adjacent to each other to form a subassembly 100 that may be rectangular in shape. The four LRUs may fit together in a puzzle-type arrangement such that an edge 32*a* of each I/O panel 32 of an LRU 30 engages the edge 32*a* of an adjacent I/O panel 32. The edges engage both in the horizontal and vertical direction. Each rear surface 38 of the I/O panels of the four LRUs are flat with each other and extend in a common plane, such that the precise alignment of each LRU 30 is ensured. Each subassembly 100 may include two sets of identical or nearly identical LRUs 30*a*, 30*b* and the identical LRUs 30*a*, 30*b* are arranged diagonally relative to each other within the subassembly 100. For example, the first set of LRUs may include an LRU 30*a* and the second set of LRUs may include an LRU 30*b*, with the LRU 30*a* having a non-identical LRU 30*b* arranged adjacent to the LRU 30*a* in the vertical and horizontal direction. Similarly, the LRU 30*b* has a non-identical LRU 30*a* arranged adjacent to the LRU 30*b* in the vertical and horizontal direction. In other exemplary embodiments, the frame support structure 68 and LRUs may be configured in other arrangements and subassemblies. For example, all of the LRUs may be identical or nearly identical.

The LRUs 30*a*, 30*b* are arranged such that a set of non-identical LRUs 30*a*, 30*b* share a corresponding vertical beam 80 and another set of non-identical LRUs 30*a*, 30*b* share a corresponding horizontal beam 78. For example, the shear fasteners 72, 74 of the LRU 30*b* may be attached to the LRU mounting surface 84 of the horizontal beam 78 and the shear fasteners 74, 76 of the LRU 30*b* may be attached to the LRU mounting surface of the vertical beam 80. The shear fastener 74 is arranged at the junction between the horizontal beam 78 and the vertical beam 80. The shear fasteners 74*a*, 76*a* of the LRU 30*a* may be arranged on the same vertical beam 80 as the shear fasteners 74, 76 of the LRU 30*b*. The shear fasteners 72*a*, 74*a* of the LRU 30*a* may be arranged along a horizontal beam 78*a* that is parallel with the horizontal beam 78 and opposite the subassembly 100 of LRUs relative to the horizontal beam 78. The shear fastener 74*a* of the LRU 30*a* is arranged at the junction between the vertical beam 80 and the horizontal beam 78*a*.

Positioning the bracket 34 within the frame support structure 68 may be further aided using any suitable assembly aid 102 that is configured to engage with the bracket 34 and prevent lateral shifting of the LRU 32. The assembly aid 102 may be configured to lead the fasteners 72, 74, 76 into corresponding fastener receiving holes. In an exemplary embodiment, the assembly aid 102 may be formed as a block or similar protrusion that is attached to the LRU mounting surface 84 and a horizontal beam portion 103 of a corresponding one of the orthogonal beams 78, 80. One of the orthogonal flanges 58, 60 of the bracket 34 may include a complementary recess 104 that at least partially receives the assembly aid 102 when the LRU 30 is assembled into the frame support structure 68. The frame support structure 68 may include a plurality of assembly aids that are spaced along the orthogonal beams 78, 80. Assembly aids may be arranged on the horizontal beams, the vertical beams, or both. Other suitable assembly aids, such as clamps, couplers, and fasteners, may also be used.

Providing two sets of identical or nearly identical LRUs 30*a*, 30*b* is further advantageous in that the arrangement enables the position of each pull mechanism or handle 56 to be centered or in an area of the opening 82 that is most accessible to the operator. For example, each handle 56 may be arranged proximate a corner 106 of the corresponding LRU 30 that is distally opposite the corner at which the bracket 34 forms the right-angle. Accordingly, each corner 106 of the four LRUs 30, 30*a*, 30*b* are engageable in a central location of the corresponding opening 82 and the handle 56 of each LRU 30 are arranged proximate to each other at the central location, with the brackets of the LRUs forming a rectangular outer perimeter of the subassembly 100. Advantageously, all four LRUs may be accessed and undergo maintenance by the operator from the same or a single position or location of the operator.

Figure 10:
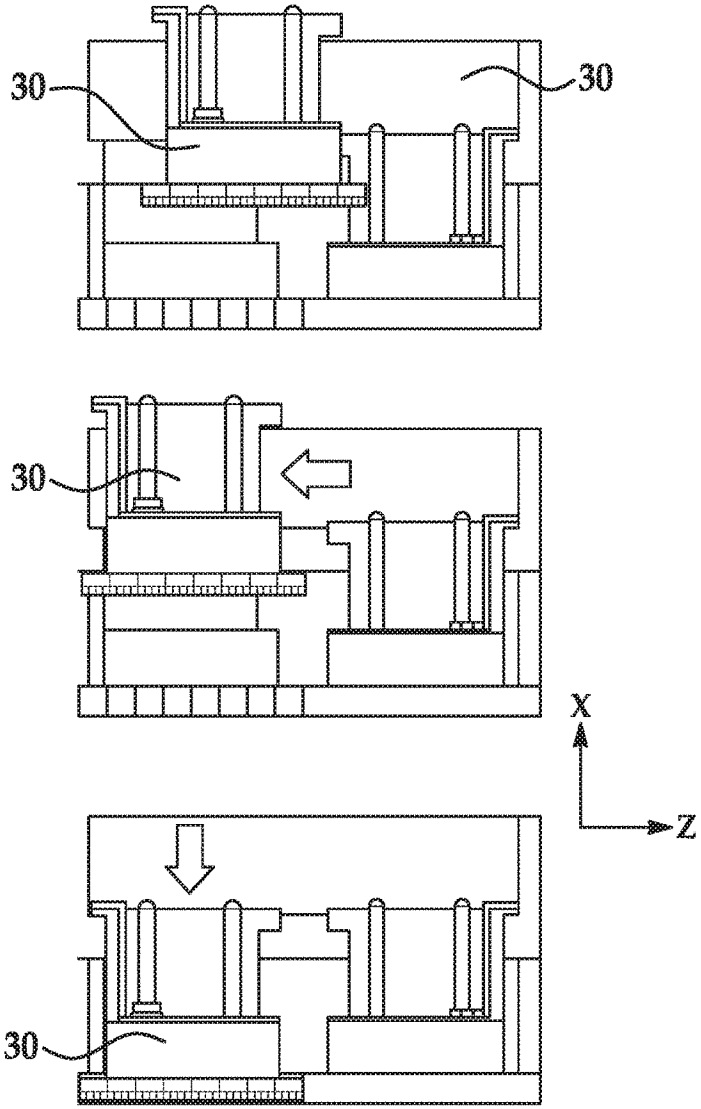
FIG. 10 shows the removal of one of the LRUs of the subassembly of FIG. 9.
Figure 11:
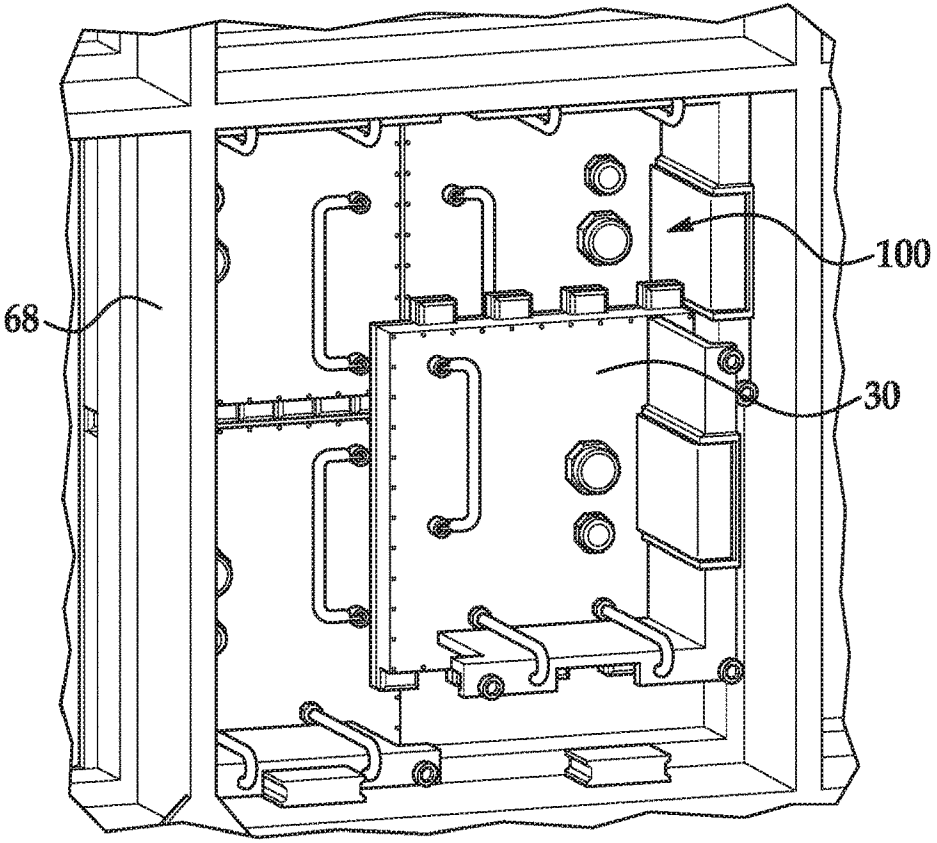
FIG. 11 shows one of the LRUs removed from the subassembly of FIG. 7.

Referring in addition to FIGS. 10 and 11, the removal operation of an LRU 30 from the frame support structure 68 is schematically shown. FIG. 9 shows the subassembly 100 of LRUs when assembled and FIG. 11 shows one of the LRUs 30 being removed from the subassembly 100. FIG. 10 shows a top view of the movement of the LRU 30 being removed. The fasteners 72, 74, 76 corresponding to the LRU 30 are preliminarily removed and the LRU 30 is first extracted in the rear direction or z-direction such that the LRU 30 is displaced rearwardly and outwardly relative the other LRUs. In an exemplary application, the LRU 30 may be moved in the rear direction by a distance that is approximately 5 centimeters (2 inches). The LRU 30 may then be moved in a lateral direction, or in the x-direction and y-direction towards the central location of the subassembly 100, such that the LRU 30 may then be entirely removed from the subassembly 100, while the remaining LRUs remain in place. In a similar but reverse operation, the LRU 30 may be replaced or reattached to the subassembly 100 after maintenance is performed. The LRU 30 may be rotated in the x-y direction to slide the LRU 30 in and out of place. Using the LRU 30 is further advantageous in that the RF panel 42 and additional electrical and mechanical components of the LRU 30 may be removed as a single and self-contained unit.

Figure 12:
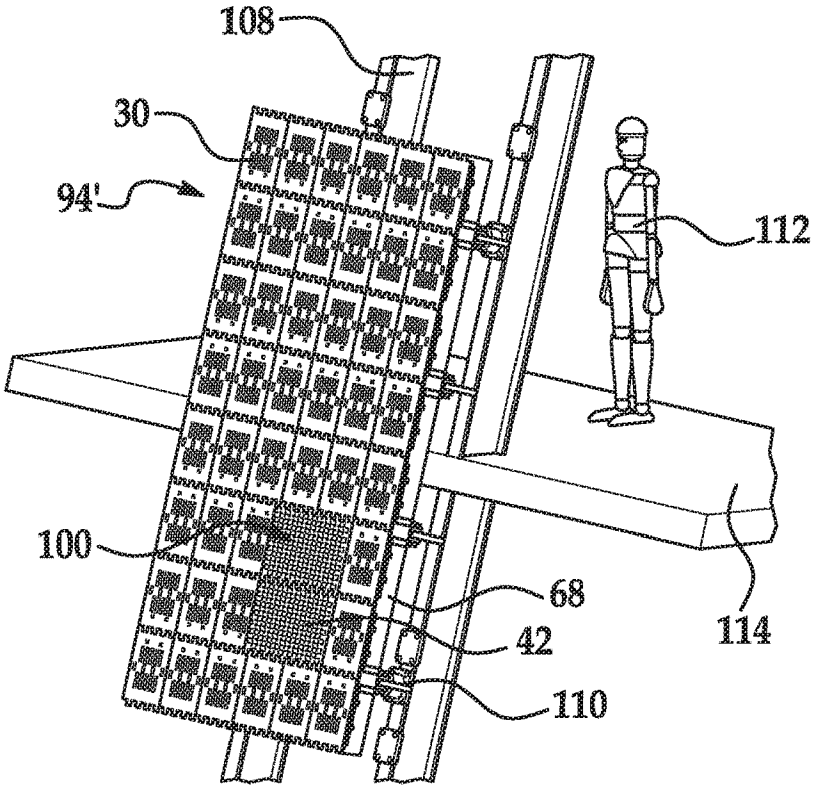
FIG. 12 shows a front oblique view of an array antenna assembly mounted to a building.
Figure 13:
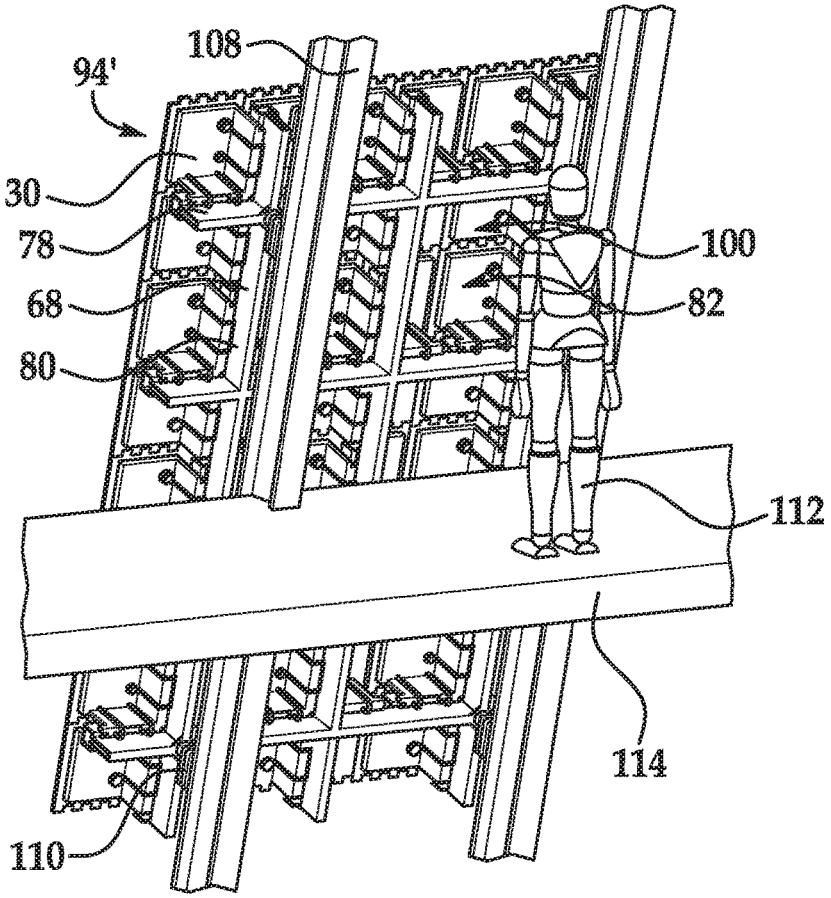
FIG. 13 shows a rear oblique view of the array antenna assembly of FIG. 12.
Figure 14:
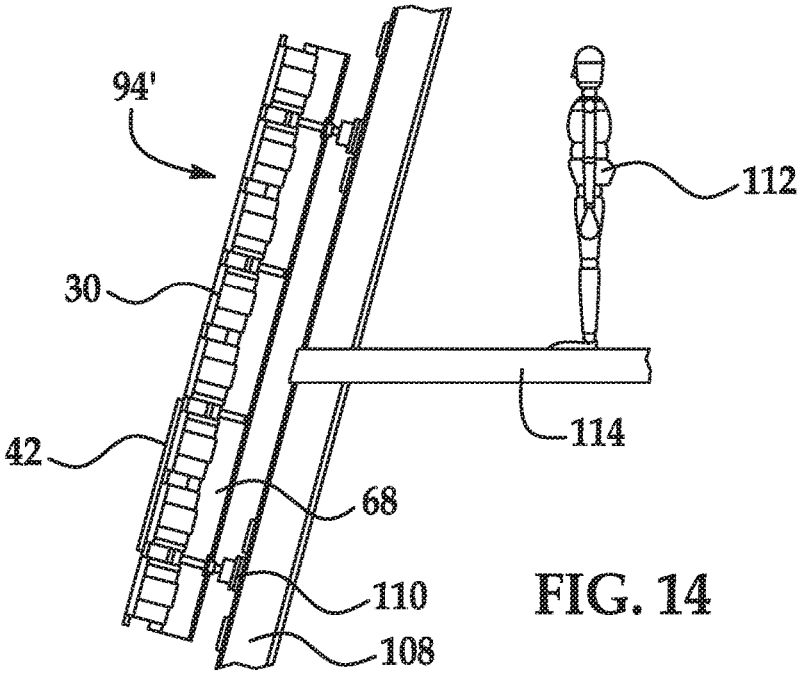
FIG. 14 shows a side view of the array antenna assembly of FIG. 12.

Referring now to FIGS. 12-15, an exemplary array antenna assembly 94' is shown in an assembled state on a side of a stationary building. The exemplary array antenna assembly 94' has 48 LRUs and 3072 antenna elements, but many other configurations are suitable. The LRUs have a rectangular arrangement. FIG. 12-14 show the LRUs without each RF panel 42 in place, and a subassembly 100 of four LRUs having the RF panel 42 is shown. When assembled, an RF panel 42 will be configured for each LRU 30, similar to the arrangement shown in FIG. 7. The array antenna assembly 94' has a surface area that is between 8 and 10 $m^2$ and the assembly 94' is mounted to at least one support beam 108 of the building. The frame support structure 68 is connected between the LRUs and the support beam 108. The support beam 108 may extend parallel with each vertical orthogonal beam 80 of the frame support structure 68 such that the array antenna assembly 94' extends substantially parallel with a plurality of support beams of the building.

Figure 15:
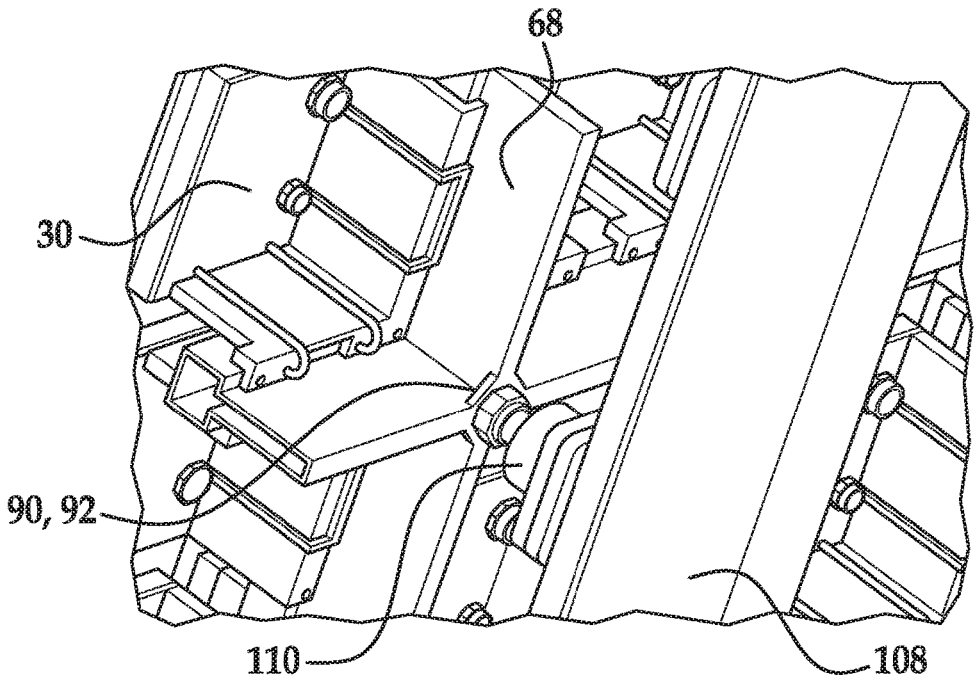
FIG. 15 shows a detailed view of a connection between the array antenna assembly and a support beam of the building of FIG. 12.

The frame support structure 68 is connected to the support beam 108 by any suitable connection. As best shown in FIG. 15, a screw-type support 110 may be bolted or attached to the beam 108 such that the attachment points 90, 92 of the frame support structure 68 (as also shown in FIG. 6) may be screwed in to each screw-type support 110. Other types of supports or attachment devices may be suitable. During an exemplary assembly process for the array antenna assembly 94', the LRUs may be assembled using a crane. Using the screw-type support 110 is advantageous in that the support 110 may be adjustable to adjust for different parameters in the x, y, and z-directions. Although a stationary building is described, the array antenna assembly 94' may be suitable for mounting to another stationary platform or a moving platform such as a sea vessel, land vehicle, aircraft, or space vehicle.

When assembled and access of an LRU 30 is desired, an operator 112 may be positioned on a deck 114 of the building that is fixed with the support beams. When the operator 112 is on the deck 114, the operator 112 faces the rear side of the array antenna assembly 94' which is opposite to the side of the array antenna assembly 94' on which the antenna elements are located. The operator 112 is able to reach through the opening 82 of the frame support structure 68 and pull the LRU 30 in the rearward direction toward the operator 112 and away from the array antenna assembly 94' such that maintenance can be performed and the LRU 30 can be placed back into the subassembly 100. The LRU 30 can be replaced without disturbing the other LRUs in the array antenna assembly 94'. The operator 112 may grab a pull mechanism or handle of the LRU 30, as shown in FIGS. 2 and 3. Although a manual operator is described, the rear side of the array antenna assembly 94' may also be accessible by an automatic machine, such as a robot configured to perform routine or automated maintenance on the array antenna assembly 94'.

Figure 16:
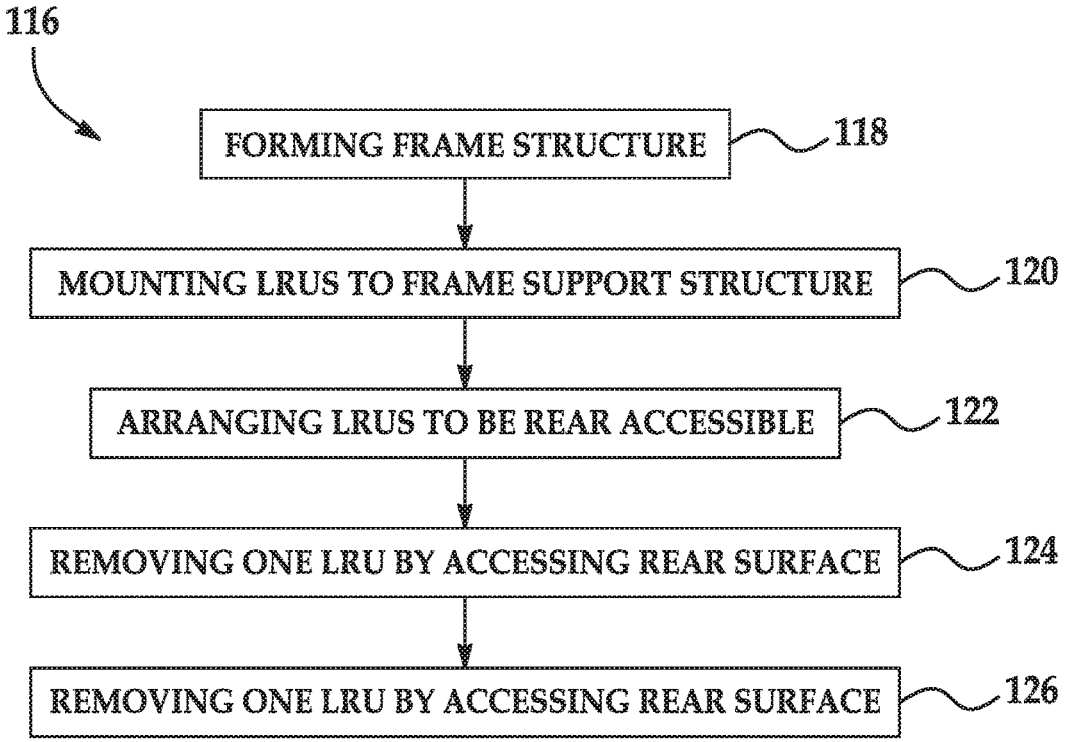
FIG. 16 shows a flow chart illustrating a method of assembling and maintaining an array antenna assembly.

Referring now to FIG. 16, a flowchart of a method 116 of assembling and maintaining an array antenna assembly 94, 94' (shown in FIGS. 7, 8, and 12-14) is shown. Step 118 of the method 116 includes forming a frame support structure 68 (shown in FIG. 5). Step 118 may further include mounting the frame support structure 68 to a support beam 108 (shown in FIGS. 12-13) on an existing structure, such as a stationary or moving platform. Step 120 of the method 116 includes mounting a plurality of LRUs (shown in FIGS. 1-4) to the frame support structure 68. Each LRU 30 has an I/O panel 32 with a front surface 36 and a rear surface 38, and a bracket 34 extending perpendicular from the rear surface 38. The bracket 34 has orthogonal flanges 58, 60 that provide a predetermined alignment of the LRUs. Step 120 may further include arranging four LRUs per an opening 82 of the frame support structure 68 (shown in FIG. 5) to form the subassembly 100 (shown in FIGS. 8 and 9) and a plurality of subassemblies.

Step 122 of the method 116 includes arranging the LRU to be rear accessible, such that a rear surface 38 of the I/O panel 32 (shown in FIGS. 2 and 3) may be accessed for removing the entire LRU 30 from the array antenna assembly 94, 94'. Arranging the LRUs to be rear accessible includes arranging the rear surface 38 to be accessible through the opening 82 defined by the orthogonal beams 78, 80 of the frame support structure 68. Step 124 of the method 116 includes removing one LRU 30 by accessing the rear surface 38 of the LRU 30 through the frame support structure 68. Step 124 may include moving the LRU 30 in a rear direction away from the other LRUs and then moving the LRU 30 in a lateral direction away from the frame support structure 68 such that the LRU may be removed and replaced, or undergo maintenance and be placed back into the array antenna assembly 94, 94'.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A line replaceable unit for an array antenna, the line replaceable unit comprising:

an electromechanical panel having a front surface in communication with electronics of the array antenna, and a rear surface opposing the front surface; and a mounting bracket that is attached to the rear surface and extends perpendicular to the rear surface opposite the electronics, wherein the mounting bracket is a right-angle bracket that has orthogonal flanges that are configured to align the line replaceable unit within the array antenna, wherein a right angle is formed by the orthogonal flanges at a corner of the rear surface, wherein at least one of the orthogonal flanges is formed as an electromechanical interface in addition to the electromechanical panel.

2. The line replaceable unit according to claim 1, wherein the orthogonal flanges extend along outer edges of the rear surface, whereby most of the rear surface is exposed.

3. The line replaceable unit according to claim 1, wherein the two orthogonal flanges are integrally formed.

4. The line replaceable unit according to claim 1, wherein at least one of the orthogonal flanges includes at least one of a cooling element or an RF connector.

5. The line replaceable unit according to claim 1 further comprising a pull mechanism mounted on the rear surface of the panel.

6. An array antenna assembly comprising:

a frame support structure; and a plurality of line replaceable units according to claim 1, wherein each of the plurality of line replaceable units includes a plurality of radiating elements disposed on the front surface wherein the orthogonal flanges of each of the plurality of line replaceable units are engageable with the frame support structure to align the plurality of line replaceable units within the array antenna.

7. The array antenna assembly according to claim 6, wherein the frame support structure is grid-shaped and defines a plurality of openings through which the rear surface of each of the plurality of line replaceable units is accessible.

8. The array antenna assembly according to claim 7, wherein each of the openings is configured to support a subassembly of the plurality of line replaceable units having four line replaceable units.

9. The array antenna assembly according to claim 8, wherein the subassembly includes two sets of identical line replaceable units, wherein the identical line replaceable units are diagonally opposed to each other.

10. The array antenna assembly according to claim 8, wherein the rear surface of each of the four line replaceable units lay flat with each other in a common plane.

11. The array antenna assembly according to claim 6 further comprising a plurality of fasteners that connect the plurality of line replaceable units to the frame support structure.

12. The array antenna assembly according to claim 11, wherein the plurality of fasteners are shear fasteners that are attached between the bracket and the frame support structure.

13. The array antenna assembly according to claim 12, wherein the frame support structure includes a plurality of orthogonal beams that each have a first mounting surface and a second mounting surface that extends from the first mounting surface, wherein the shear fasteners are engageable against the first mounting surface.

14. A method of assembling an array antenna assembly according to claim 6, the method comprising:

forming the frame support structure; and mounting the plurality of line replaceable units to the frame support structure by engaging the orthogonal flanges with the frame support structure to align the plurality of line replaceable units within the array antenna.

15. The method according to claim 14 further comprising mounting the frame support structure to a support beam on an existing structure.

16. The method according to claim 14, wherein mounting the plurality of line replaceable units includes arranging the rear surface of each of the plurality of line replaceable units to be accessible through openings defined by a plurality of orthogonal beams of the frame support structure.

17. The method according to claim 14, wherein mounting the plurality of line replaceable units to the frame support structure includes arranging four line replaceable units to form a subassembly that is configured to fit into one of the openings.

18. The method according to claim 14 further comprising removing one of the line replaceable units from the frame supporting structure by accessing the rear surface through the frame support structure.

19. The method according to claim 18, wherein removing one of the line replaceable units includes moving the line replaceable unit in a rear direction away from a plane in which the other line replaceable units are arranged, and moving the line replaceable unit in a lateral direction away from the frame support structure.

* * * * *